US010697039B2

(12) United States Patent
Kariya et al.

(10) Patent No.: US 10,697,039 B2
(45) Date of Patent: Jun. 30, 2020

(54) HIGH-STRENGTH STEEL SHEET AND METHOD FOR MANUFACTURING THE SAME

(71) Applicant: JFE STEEL CORPORATION, Tokyo (JP)

(72) Inventors: Nobusuke Kariya, Fukuyama (JP); Yoshihiko Ono, Fukuyama (JP); Yoshimasa Funakawa, Chiba (JP); Kazuma Mori, Chiba (JP); Reiko Sugihara, Chiba (JP); Kenji Kawamura, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 381 days.

(21) Appl. No.: 15/542,272

(22) PCT Filed: Aug. 28, 2015

(86) PCT No.: PCT/JP2015/004381

§ 371 (c)(1),
(2) Date: Jul. 7, 2017

(87) PCT Pub. No.: WO2016/113781

PCT Pub. Date: Jul. 21, 2016

(65) Prior Publication Data

US 2018/0002778 A1 Jan. 4, 2018

(30) Foreign Application Priority Data

Jan. 16, 2015 (JP) ..... 2015-006312

(51) Int. Cl.

| | |
|---|---|
| ***C21D 9/46*** | (2006.01) |
| ***C22C 38/06*** | (2006.01) |
| ***C22C 38/40*** | (2006.01) |
| ***C22C 38/12*** | (2006.01) |
| ***C22C 38/04*** | (2006.01) |
| ***C22C 38/50*** | (2006.01) |
| ***C22C 38/00*** | (2006.01) |
| ***C22C 38/18*** | (2006.01) |

(Continued)

(52) U.S. Cl.

CPC ..... *C21D 9/46* (2013.01); *B21B 1/22* (2013.01); *B21B 3/00* (2013.01); *B21B 3/02* (2013.01); *C21D 6/001* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/40* (2013.01); *C22C 38/50* (2013.01); *C22C 38/58* (2013.01); *C22C 38/60* (2013.01); *C23G 1/00* (2013.01); *B21B 2001/221* (2013.01); *B21B 2001/225* (2013.01); *C21D 2211/002* (2013.01); *C21D 2211/003* (2013.01);

(Continued)

(58) Field of Classification Search

CPC ..... C21D 9/46; C21D 8/0247; C21D 8/0263; C21D 8/0226; C21D 8/0205; C21D 6/008; C21D 6/005; C21D 6/002; C21D 6/001; C21D 2211/008; C21D 2211/005; C21D 2211/003; C21D 2211/002; C22C 38/60; C22C 38/14; C22C 38/58; C22C 38/18; C22C 38/00; C22C 38/50; C22C 38/04; C22C 38/12; C22C 38/40; C22C 38/06; C22C 38/38; C22C 38/32; C22C 38/28; C22C 38/26; C22C 38/24; C22C 38/22; C22C 38/16; C22C 38/08; C22C 38/02; C22C 38/005; C22C 38/002; C22C 38/001; C23G 1/00; B21B 2001/225; B21B 2001/221; B21B 3/00; B21B 3/02; B21B 1/22

See application file for complete search history.

(56) References Cited

U.S. PATENT DOCUMENTS

| | | | |
|---|---|---|---|
| 2011/0030857 | A1 | 2/2011 | Kwak et al. |
| 2012/0040203 | A1 | 2/2012 | Takagi et al. |

(Continued)

FOREIGN PATENT DOCUMENTS

| | | | |
|---|---|---|---|
| CN | 101932745 | A | 12/2010 |
| CN | 102918174 | A | 2/2013 |

(Continued)

OTHER PUBLICATIONS

Chinese Office Action for Chinese Application No. 201580073322.1, dated Apr. 4, 2018, including Concise Statement of Search Report, 12 pages.

(Continued)

*Primary Examiner* — John A Hevey
(74) *Attorney, Agent, or Firm* — RatnerPrestia

(57) ABSTRACT

Provided are a high-strength steel sheet and a method for manufacturing the steel sheet. The high-strength steel sheet has a specified chemical composition with the balance being Fe and inevitable impurities, a microstructure including, in terms of area ratio, 25% or less of a ferrite phase, 75% or more of a bainite phase and/or a martensite phase, and 5% or less of cementite, in which, in a surface layer that is a region within 50 μm from the surface in the thickness direction, the area ratio of a ferrite phase is 5% to 20%, and a tensile strength is 1180 MPa or more.

5 Claims, No Drawings

(51) Int. Cl.

| | |
|---|---|
| ***B21B 3/00*** | (2006.01) |
| ***C22C 38/58*** | (2006.01) |
| ***C22C 38/14*** | (2006.01) |
| ***C22C 38/60*** | (2006.01) |
| ***B21B 1/22*** | (2006.01) |
| ***B21B 3/02*** | (2006.01) |
| ***C21D 6/00*** | (2006.01) |
| ***C21D 8/02*** | (2006.01) |
| ***C22C 38/02*** | (2006.01) |
| ***C22C 38/08*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C23G 1/00*** | (2006.01) |

(52) U.S. Cl.
CPC .. *C21D 2211/005* (2013.01); *C21D 2211/008* (2013.01)

(56) References Cited

U.S. PATENT DOCUMENTS

| | | | | |
|---|---|---|---|---|
| 2012/0216925 | A1* | 8/2012 | Kobayashi | B21D 22/022 148/654 |
| 2013/0071687 | A1* | 3/2013 | Takagi | C21D 8/0226 428/659 |
| 2013/0295402 | A1 | 11/2013 | Oh et al. | |
| 2014/0290810 | A1 | 10/2014 | Kimura et al. | |
| 2014/0342184 | A1 | 11/2014 | Takagi et al. | |

FOREIGN PATENT DOCUMENTS

| | | | | |
|---|---|---|---|---|
| CN | 103392022 | A | 11/2013 | |
| CN | 103882320 | A | 6/2014 | |
| EP | 2258887 | A1 | 12/2010 | |
| EP | 2578718 | A1 | 4/2013 | |
| EP | 2660345 | A2 * | 11/2013 | B32B 15/012 |
| EP | 2660345 | A2 | 11/2013 | |
| JP | 2001335890 | A | 12/2001 | |
| JP | 2007231395 | A | 9/2007 | |
| JP | 2010138444 | A | 6/2010 | |
| JP | 2010275628 | A | 12/2010 | |
| JP | 2011063877 | A | 3/2011 | |
| JP | 2012082499 | A | 4/2012 | |
| JP | 2014508854 | A | 4/2014 | |

OTHER PUBLICATIONS

International Search Report and Written Opinion for International Application No. PCT/JP2015/004381, dated Nov. 17, 2015—5 Pages.

Extended European Search Report for European Application No. 15877740.9, dated Dec. 22, 2017, 12 pages.

* cited by examiner

HIGH-STRENGTH STEEL SHEET AND METHOD FOR MANUFACTURING THE SAME

CROSS REFERENCE TO RELATED APPLICATIONS

This is the U.S. National Phase application of PCT/JP2015/004381, filed Aug. 28, 2015, which claims priority to Japanese Patent Application No. 2015-006312, filed Jan. 16, 2015, the disclosures of each of these applications being incorporated herein by reference in their entireties for all purposes.

TECHNICAL FIELD OF THE INVENTION

The present invention relates to a high-strength steel sheet having a tensile strength of 1180 MPa or more and excellent bending workability and a method for manufacturing the steel sheet. The high-strength steel sheet according to the present invention can suitably be used as a material for, for example, automobile parts.

BACKGROUND OF THE INVENTION

Nowadays, attempts have been made to reduce exhaust gases such as $CO_2$ from the viewpoint of global environment conservation. In the automobile industry, consideration is given to taking measures to reduce the amount of exhaust gases by increasing fuel efficiency through the weight reduction of an automobile body.

Examples of a method for reducing the weight of an automobile body include a method in which the thickness of a steel sheet which is used for an automobile is decreased by increasing the strength of the steel sheet. It is known that there is a problem with this method in that bending workability decreases with an increase in the strength of a steel sheet. Therefore, there is a demand for a steel sheet having a high strength and good bending workability at the same time.

There is a tendency for a variation in the mechanical properties of a product to increase with an increase in the strength level of a high-strength steel sheet, and there is an increase in variation in bending workability within a product in the case where a variation in mechanical properties is large. It is important that a variation in bending workability within a product does not become large, and, for example, there is a demand for stability of bending workability throughout a product from the viewpoint of increasing the yield of parts in the case where a part is manufactured by performing form molding which involves many portions to be subjected to bending work. Here, the term "a product" refers to a high-strength steel sheet. Therefore, the term "a variation in mechanical properties within a product" refers to a case where, when bending workability is determined at various positions, there is a variation in the determined result. In addition, a variation in properties in the width direction of a steel sheet, which is a product, is regarded as a problem.

In response to such a demand, for example, Patent Literature 1 discloses a high-proportion-limit steel sheet excellent in terms of bending workability and a method for manufacturing the steel sheet. Specifically, Patent Literature 1 discloses a method in which a proportion limit and bending workability are increased at the same time by performing cold rolling on a steel sheet having a specified chemical composition and by then annealing the cold-rolled steel sheet in a specified range of the temperature which is equal to or lower than the recrystallization temperature in order to allow the rearrangement of dislocations to occur while inhibiting the excessive recovery. In Patent Literature 1, bending workability is evaluated by performing a 90-degree V-bending test. However, since no consideration is given to the position to be evaluated in Patent Literature 1, it can be said that the stability of bending workability is not improved by the method in Patent Literature 1. Moreover, in the case of the method according to Patent Literature 1, since long-time annealing in a batch annealing furnace is indispensable after cold rolling has been performed, there is a problem of a decrease in productivity in comparison with continuous annealing.

Patent Literature 2 discloses a steel sheet excellent in terms of bending workability and drilling resistance. Specifically, Patent Literature 2 discloses a method in which bending workability is increased, for example, by rapidly cooling a steel sheet after rolling has been performed or after rolling followed by reheating has been performed in order to form a microstructure including mainly martensite or a mixed microstructure including martensite and lower bainite and by controlling the value of Mn/C to be constant over the full range of the C content disclosed. In patent Literature 2, bending workability is evaluated by using a press bending method. However, since no consideration is given to the position to be evaluated in Patent Literature 2, it can be said that stable bending workability is not increased by the method in Patent Literature 2. Moreover, in Patent Literature 2, although specification regarding Brinell hardness is defined, specification regarding tensile strength is not disclosed.

Patent Literature 3 discloses a high-strength steel sheet excellent in terms of bendability and a method for manufacturing the steel sheet. Specifically, Patent Literature 3 discloses a method in which a steel sheet having good close-contact bending capability in all of the rolling direction, the width direction, and the 45-degree direction is manufactured by heating steel having a specified chemical composition, by then performing rough rolling, by performing hot finish rolling which is started at a temperature of 1050° C. or lower and finished in a temperature range from the $Ar_3$ transformation temperature to (the $Ar_3$ transformation temperature+100° C.), by then cooling the hot-rolled steel sheet at a cooling rate of 20° C./s or less, by then coiling the cooled steel sheet at a temperature of 600° C. or higher, by then performing pickling, by then performing cold rolling with a rolling reduction of 50% to 70%, by then performing annealing for 30 seconds to 90 seconds in the temperature range in which an ($\alpha+\gamma$)-dual phase is formed, and by then cooling the annealed steel sheet to a temperature of 550° C. at a cooling rate of 5° C./s or more. In Patent Literature 3, bending workability is evaluated by performing close-contact bending. However, since no consideration is given to the position to be evaluated in Patent Literature 3, it can be said that stability of bending workability is not improved by the method in Patent Literature 3. In addition, in Patent Literature 3, tensile property is evaluated by performing a tensile test and the steel sheet has a strength of less than 1180 MPa. Accordingly, it cannot be said that the steel sheet has a sufficient strength for a high-strength steel sheet to be used for an automobile.

PATENT LITERATURE

PTL 1: Japanese Unexamined Patent Application Publication No. 2010-138444

PTL 2: Japanese Unexamined Patent Application Publication No. 2007-231395

PTL 3: Japanese Unexamined Patent Application Publication No. 2001-335890

SUMMARY OF THE INVENTION

Aspects of the present invention have been completed in view of the situation described above, and an object according to aspects of the present invention is to provide a high-strength steel sheet having a tensile strength of 1180 MPa or more and excellent bending workability stably within a product and a method for manufacturing the steel sheet.

The present inventors, in order to solve the problems described above, diligently conducted investigations from the viewpoint of the chemical composition and microstructure (metallographic structure) of a steel sheet, and, as a result, found that, in order to solve the problems described above, it is very important to control a chemical composition to be within an appropriate range and to appropriately control a metallographic structure.

In order to form a metallographic structure for achieving good bending workability, it is necessary to form a multi-phase microstructure including a martensite phase and/or a bainite phase as a main phase and a ferrite phase. It is possible to form such a multi-phase microstructure by cooling a steel sheet to a specified temperature after annealing has been performed. Here, since there is a decrease in the B (boron) content in the surface layer of a steel sheet due to an atmosphere during annealing or cooling to form the multi-phase microstructure described above, there is an increase in the area ratio of a ferrite phase in the surface layer due to a decrease in hardenability in the surface layer. Since the concentration of C occurs in austenite due to an increase in the area ratio of a ferrite phase, there is a case where a hard martensite phase and/or a hard bainite phase are formed in the surface layer. In the case where the microstructure of the surface layer is a multi-phase microstructure including ferrite in combination with a hard martensite phase and/or a hard bainite phase, since the difference in hardness between ferrite and a martensite phase or a bainite phase is large, it is not possible to stably achieve high bending workability within a product. Here, the term "a surface layer" (also referred to as "the surface layer of a steel sheet" or "a surface layer in the thickness direction") refers to a region within 50 μm from the surface in the thickness direction.

In contrast, the present inventors found that, as described above, by specifying the chemical composition (in particular, the Sb content is important) and microstructure of a steel sheet, it is possible to obtain a steel sheet having good bending workability stably within a product despite having a tensile strength of 1180 MPa or more. That is, regarding a microstructure, satisfactory strength is achieved by specifying the area ratio of a bainite phase and/or a martensite phase, and satisfactory bendability and ductility are achieved by appropriately controlling the area ratios of a ferrite phase and cementite. Moreover, it is made to be possible to achieve high bending workability stably within a product by appropriately controlling the area ratio of a ferrite phase in the surface layer.

Aspects of the present invention have been completed on the basis of the knowledge described above and is characterized as follows.

[1] A high-strength steel sheet having a chemical composition containing, by mass %, C: 0.100% to 0.150%, Si: 0.30% to 0.70%, Mn: 2.20% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, Ca: 0.0015% or less, and the balance being Fe and inevitable impurities, a microstructure including, in terms of area ratio, 25% or less of a ferrite phase, 75% or more of a bainite phase and/or a martensite phase, and 5% or less of cementite, in which, in a surface layer that is a region within 50 μm from the surface in the thickness direction, the area ratio of a ferrite phase is 5% to 20%, and a tensile strength is 1180 MPa or more.

[2] The high-strength steel sheet according to item [1], in which the chemical composition further contains, by mass %, one or more elements selected from Cr: 0.30% or less, V: 0.10% or less, Mo: 0.20% or less, Cu: 0.10% or less, and Ni: 0.10% or less.

[3] The high-strength steel sheet according to item [1] or [2], in which the chemical composition further contains, by mass %, REM: 0.0010% to 0.0050%.

[4] The high-strength steel sheet according to any one of items [1] to [3], the steel sheet further having a YR of 0.85 or less.

[5] A method for manufacturing a high-strength steel sheet having a tensile strength of 1180 MPa or more and excellent bending workability, the method including a hot rolling process in which finish rolling is performed on a steel material having the chemical composition according to any one of items [1] to [3] at a temperature equal to or higher than the $Ar_3$ transformation temperature and in which coiling is performed at a temperature of 600° C. or lower; a pickling process in which pickling is performed on the hot-rolled steel sheet after the hot rolling process; and a continuous annealing process in which the steel sheet which has been pickled in the pickling process is heated to a temperature range of 570° C. or higher at an average heating rate of 2° C./s or more, in which a holding time during which the steel sheet is held in a temperature range equal to or higher than the $Ac_3$ transformation temperature is 60 seconds or more, in which the held steel sheet is then cooled to a temperature range of 620° C. to 740° C. at an average cooling rate of 0.1° C./s to 8° C./s, in which a holding time during which the cooled steel sheet is held in the temperature range is 10 seconds to 50 seconds, in which the held steel sheet is then cooled to a temperature range of 400° C. or lower at an average cooling rate of 5° C./s to 50° C./s, and in which a holding time during which the cooled steel sheet is held in a temperature range of 150° C. or higher and 400° C. or lower is 200 seconds to 800 seconds.

[6] The method for manufacturing a high-strength steel sheet according to item [5], the method further including a cold rolling process in which cold rolling is performed on the pickled steel sheet after the pickling process and before the continuous annealing process.

According to aspects of the present invention, it is possible to obtain a high-strength steel sheet having a tensile strength of 1180 MPa or more and excellent bending workability. The high-strength steel sheet according to aspects of the present invention is excellent in terms of bending workability stably within a product. Therefore, for example, in the case where the high-strength steel sheet according to aspects of the present invention is used for the structural members of an automobile, the steel sheet contributes to the weight reduction of an automobile body. Since there is an increase in the fuel efficiency of an automobile due to the weight reduction of an automobile body, and since there is an increase in the yield of parts, the utility value according to aspects of the present invention is significantly large in the industry.

DETAILED DESCRIPTION OF EMBODIMENTS OF THE INVENTION

Hereafter, the embodiments of the present invention will be specifically described. Here, the present invention is not limited to the embodiments below.

<High-Strength Steel Sheet>

The chemical composition of the high-strength steel sheet according to aspects of the present invention has a chemical composition containing, by mass %, C: 0.100% to 0.150%, Si: 0.30% to 0.70%, Mn: 2.20% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, and Ca: 0.0015% or less.

First, the above-mentioned chemical composition will be described. Here, in the present specification, "%" used when describing a chemical composition refers to "mass %".

C: 0.100% to 0.150%

C is a chemical element which is indispensable for achieving a desired strength. In order to produce such an effect, it is necessary that the C content be 0.100% or more. On the other hand, in the case where the C content is more than 0.150%, since there is a significant increase in strength, it is not possible to achieve a desired bending workability. Therefore, the C content is set to be in the range of 0.100% to 0.150%.

Si: 0.30% to 0.70%

Si is a chemical element which is effective for increasing the strength of steel without significantly decreasing the ductility of steel. In addition, Si is a chemical element which is important for controlling the area ratio of a ferrite phase in a surface layer. In order to produce the effects described above, it is necessary that the Si content be 0.30% or more. However, in the case where the Si content is more than 0.70%, since there is a significant increase in strength, it is not possible to achieve a desired bending workability. Therefore, the Si content is set to be 0.30% to 0.70%, or preferably 0.45% to 0.70%.

Mn: 2.20% to 2.80%

Mn is, like C, a chemical element which is indispensable for achieving a desired strength. In addition, Mn is a chemical element which is important for stabilizing an austenite phase in order to inhibit the formation of ferrite during cooling in a continuous annealing process. In order to produce the effects described above, it is necessary that the Mn content be 2.20% or more. However, in the case where the Mn content is more than 2.80%, since there is an excessive increase in the area ratio of a hard microstructure, there is a decrease in bending workability. Therefore, the Mn content is set to be 2.80% or less, preferably 2.40% to 2.80%, or more preferably 2.50% to 2.80%.

P: 0.025% or Less

Since P is a chemical element which is effective for increasing the strength of steel, P may be added in accordance with the strength level of a steel sheet. In order to produce such an effect, it is preferable that the P content be 0.005% or more. On the other hand, in the case where the P content is more than 0.025%, there is a decrease in weldability. Therefore, the P content is set to be 0.025% or less. In addition, in the case where more excellent weldability is required, it is preferable that the P content be 0.020% or less.

S: 0.0020% or Less

S forms non-metal inclusions such as MnS. A crack tends to occur at the interface between a non-metal inclusion and a metallographic structure in a bending test. Therefore, there is a decrease in bending workability in the case where S is contained. Therefore, since it is preferable that the S content be as small as possible, the S content is set to be 0.0020% or less in accordance with aspects of the present invention. In addition, in the case where more excellent bending workability is required, it is preferable that the S content be 0.0015% or less.

Al: 0.020% to 0.060%

Al is a chemical element which is added for the deoxidation of steel. In accordance with aspects of the present invention, it is necessary that the Al content be 0.020% or more. On the other hand, in the case where the Al content is more than 0.060%, there is a deterioration in surface quality. Therefore, the Al content is set to be in the range of 0.020% to 0.060%.

N: 0.0050% or Less

In the case where N combines with B to form B nitrides, since there is a decrease in the amount of B, which increases hardenability during cooling in a continuous annealing process, there is an excessive increase in the area ratio of a ferrite phase in a surface layer, which results in a deterioration in bending workability. Therefore, in accordance with aspects of the present invention, it is preferable that the N content be as small as possible. Therefore, the N content is set to be 0.0050% or less, or preferably 0.0040% or less.

Nb: 0.010% to 0.060%

Nb is a chemical element which is effective for increasing the strength of steel and for refining microstructure of steel by forming carbonitrides in steel. In order to produce such effects, the Nb content is set to be 0.010% or more. On the other hand, in the case where the Nb content is more than 0.060%, since there is a significant increase in strength, it is not possible to achieve a desired bending workability. Therefore, the Nb content is set to be in the range of 0.010% to 0.060%, or preferably 0.020% to 0.050%.

Ti: 0.010% to 0.030%

Ti is, like Nb, a chemical element which is effective for increasing the strength of steel and for refining microstructure of steel by forming carbonitrides in steel. In addition, Ti inhibits the formation of B nitrides, which cause a decrease in hardenability. In order to produce such effects, the Ti content is set to be 0.010% or more. On the other hand, in the case where the Ti content is more than 0.030%, since there is a significant increase in strength, it is not possible to achieve a desired bending workability. Therefore, the Ti content is set to be in the range of 0.010% to 0.030%, or preferably 0.010% to 0.025%.

B: 0.0005% to 0.0030%

B is a chemical element which is important for inhibiting the formation of ferrite during cooling in a continuous annealing process by increasing the hardenability of steel. In addition, B is a chemical element which is effective for controlling the area ratio of a ferrite phase in a surface layer. In order to produce such effects, the B content is set to be 0.0005% or more. On the other hand, in the case where the B content is more than 0.0030%, such effects become saturated, and there is an increase in rolling load in hot rolling and cold rolling. Therefore, the B content is set to be in the range of 0.0005% to 0.0030%, or preferably 0.0005% to 0.0025%.

Sb: 0.005% to 0.015%

Sb is the most important chemical element in accordance with aspects of the present invention. That is, Sb inhibits a decrease in the content of B which exists in the surface layer of steel as a result of being concentrated in the surface layer of steel in the annealing process of continuous annealing. Therefore, it is possible to control the area ratio of a ferrite phase in the surface layer to be within a desired range through the use of Sb. In order to produce such effects, the Sb content is set to be 0.005% or more. On the other hand, in the case where the Sb content is more than 0.015%, such effects become saturated, and there is a decrease in toughness due to the grain-boundary segregation of Sb. Therefore, the Sb content is set to be in the range of 0.005% to 0.015%, or preferably 0.008% to 0.012%.

Ca: 0.0015% or Less

Ca forms oxides which are elongated in the rolling direction. A crack tends to occur at the interface between an oxide and a metallographic structure in a bending test. Therefore, containing Ca decreases bending workability. Therefore, since it is preferable that the Ca content be as small as possible, the Ca content is set to be 0.0015% or less in accordance with aspects of the present invention. In addition, in the case where more excellent bending workability is required, it is preferable that the Ca content be 0.0007% or less, or more preferably 0.0003% or less.

The chemical composition according to aspects of the present invention may further contain one or more elements selected from Cr, V, Mo, Cu, and Ni as optional constituent chemical elements in addition to the constituent chemical elements described above.

Cr and V, which are able to increase the hardenability of steel, may be added in order to increase strength. Since Mo is a chemical element which is effective for increasing the hardenability of steel, Mo may be added in order to increase strength. Since Cu and Ni are chemical elements which contribute to an increase in strength, Cu and Ni may be added in order to increase strength of steel. The upper limits of the contents of these chemical elements respectively correspond to the contents with which the effects of the respective chemical elements become saturated. Therefore, in order to produce the effects described above by adding these chemical elements, the contents of these chemical elements are set to be as follows: Cr is 0.30% or less, V is 0.10% or less, Mo is 0.20% or less, Cu is 0.10% or less, and Ni is 0.10% or less, or preferably Cr is 0.04% to 0.30%, V is 0.04% to 0.10%, Mo is 0.04% to 0.20%, Cu is 0.05% to 0.10%, and Ni is 0.05% to 0.10%.

In addition, the chemical composition according to aspects of the present invention may further contain REM as an optional constituent chemical element. REM, which is able to spheroidize sulfides, is added in order to increase bending workability. The lower limit of the REM content corresponds to the minimum content with which a desired effect is produced, and the upper limit of the REM content corresponds to the content with which the effect described above becomes saturated. Therefore, in order to produce the effect described above by adding REM, the REM content is set to be 0.0010% to 0.0050%.

The remainder which is different from the constituent chemical elements and the optional constituent chemical elements described above is Fe and inevitable impurities.

Hereafter, the reasons for the limitations on the microstructure of the high-strength steel sheet according to aspects of the present invention will be described. The high-strength steel sheet according to aspects of the present invention has a microstructure including, in terms of area ratio, 25% or less of a ferrite phase, 75% or more of a bainite phase and/or a martensite phase, and 5% or less of cementite. In addition, in a surface layer, the area ratio of a ferrite phase is 5% to 20%. These limitations will be described hereafter.

Area Ratio of Ferrite Phase: 25% or Less

In order to achieve good bendability and strength, it is necessary that the area ratio of a ferrite phase be 25% or less, or preferably 15% or less.

Area Ratio of Bainite Phase and/or Martensite Phase: 75% or More

In order to achieve sufficient strength, the area ratio of a bainite phase and/or a martensite phase is set to be 75% or more, or preferably in the range of 85% or more. In addition, the meaning of the term "bainite phase" in accordance with aspects of the present invention includes both so-called upper bainite, in which plate-type cementite is precipitated along the interface of lath-structured ferrite, and so-called lower bainite, in which cementite is finely dispersed inside lath-structured ferrite. Here, it is possible to easily identify a bainite phase and/or a martensite phase by using a scanning electron microscope (SEM). In addition, in the case where a bainite phase and a martensite phase are both included, the total area ratio is set to be 75% or more, or preferably 85% or more.

Area Ratio of Cementite: 5% or Less

In order to achieve good bending workability, it is necessary that the area ratio of cementite be 5% or less. In the case where the area ratio of cementite is more than 5%, there is a deterioration in bending workability. In addition, the term "cementite" in accordance with aspects of the present invention refers to cementite which separately exists at grain boundaries without being included in any metallographic structure.

Here, besides a ferrite phase, a bainite phase, a martensite phase, and cementite, a retained austenite phase may be included in the microstructure. In this case, it is preferable that the area ratio of a retained austenite phase be 5% or less. Here, since it is preferable that the area ratio of other phases than a ferrite phase, a bainite phase, a martensite phase, and cementite be 5% or less, it is preferable that the total area ratio of a ferrite phase, a bainite phase, a martensite phase, and cementite be 95% or more.

It is possible to determine the area ratio of each of a ferrite phase, a bainite phase, a martensite phase, and cementite by polishing the cross section in the thickness direction parallel to the rolling direction of a steel sheet, by then etching the polished cross section by using a 3%-nital solution, by then observing 10 fields of view at a position located at ¼ of the thickness (position at ¼ of the thickness from the surface in the cross section described above) by using a scanning electron microscope (SEM) at a magnification of 2000 times, and by then analyzing the observed images by using image analysis software "Image-Pro Plus ver. 4.0" manufactured by Media Cybernetics, Inc. The area ratios of a ferrite phase and cementite were respectively defined as the area ratios, which had been determined by identifying these metallographic structures by performing a visual test on microstructure photographs taken by using a SEM and by performing image analysis on the photographs, divided by the areas of the analyzed fields of view. Since the remaining metallographic structures according to aspects of the present invention which are different from a ferrite phase, a retained austenite phase, and cementite are a bainite phase and/or a martensite phase, the area ratio of a bainite phase and/or a martensite phase is defined as the area ratio of the metallographic structures which are different from a ferrite phase, a retained austenite, and cementite. The meaning of the term "bainite" in accordance with aspects of the present invention includes both so-called upper bainite, in which plate-type cementite is precipitated along the interface of lath-structured ferrite, and so-called lower bainite, in which cementite is finely dispersed inside lath-structured ferrite. The area ratio of a retained austenite phase was determined by grinding the surface of a steel sheet in the thickness direction, by further performing chemical polishing on the ground surface in order to remove 0.1 mm in the thickness direction so that the position located at ¼ of the thickness of the steel sheet from the surface of the steel sheet was exposed, by then determining the integrated intensities of the (200) plane, (220) plane, and (311) plane of fcc iron and the (200) plane, (211) plane, and (220) plane of bcc iron by using the Kα ray of Mo with an X-ray diffractometer, and by then deriving the amount of retained austenite from the determined values. The area ratio of each of the metallographic structures, that is, a ferrite phase, a bainite phase, a martensite phase, and cementite was defined as the average value of the area ratios of each of the metallographic structures which had been respectively determined in the 10 fields of view.

Ferrite Phase in Surface Layer That is Region Within 50 μm From Surface in Thickness Direction In accordance with aspects of the present invention, in a surface layer that is a region within 50 μm from the surface in the thickness direction, the area ratio of a ferrite phase is 5% to 20%.

The state of a ferrite phase in a surface layer is an important criterion for determining the quality of the high-strength steel sheet according to aspects of the present invention. Specifically, a ferrite phase in a surface layer has a role in dispersing strain which is applied to a steel sheet by performing bending work. In order to achieve good bending workability by effectively dispersing strain, it is necessary that the area ratio of a ferrite phase in a surface layer be 5% or more. On the other hand, in the case where the area ratio of a ferrite phase in a surface layer is more than 20%, since there is an increase in the hardness of a second phase (a bainite phase and/or a martensite phase) due to C being excessively concentrated in the second phase, there is an increase in the difference in hardness between ferrite and the second phase, which results in a deterioration in bending workability. Therefore, the area ratio of a ferrite phase in a surface layer is set to be 20% or less. It is preferable that the above-described area ratio of a ferrite phase be 5% to 15%.

The remainder which is different from a ferrite phase is the above-described second phase (a bainite phase and/or a martensite phase), and the area ratio of the second phase is 80% to 95%.

It is possible to determine the above-mentioned area ratio of a ferrite phase by polishing the cross section in the thickness direction parallel to the rolling direction of a steel sheet, by then etching the polished cross section by using a 3%-nital solution, by then observing 10 fields of view in a region which is within 50 μm from the surface of the steel sheet in the thickness direction thereof and which is in the polished surface after etching by using a scanning electron microscope (SEM) at a magnification of 2000 times, and by then analyzing the observed images by image analysis processing using image analysis software "Image-Pro Plus ver. 4.0" manufactured by Media Cybernetics, Inc. That is, it is possible to derive the area ratio of a ferrite phase in each of the observation fields of view by distinguishing a ferrite phase on the digital image through image analysis and by performing image processing. The area ratio of a ferrite phase in a surface layer was derived by calculating the average value of the area ratios of these 10 fields of view.

YR of Steel According to Aspects of the Present Invention: 0.85 or Less

In the case where YR is excessively high, since strain is localized due to local plastic deformation, there may be a decrease in bendability. Therefore, it is desirable that YR be 0.85 or less. In addition, although there is no particular limitation on the lower limit of YR, it is preferable that the lower limit of YR be 0.72 or more in consideration of crashworthiness when used as an automobile member after having been subjected to press forming.

<Method for Manufacturing High-Strength Steel Sheet>

The method for manufacturing a high-strength steel sheet includes a hot rolling process, a pickling process, and a continuous annealing process. In addition, it is preferable that the manufacturing method according to aspects of the present invention include a cold rolling process between the pickling process and the continuous annealing process. Hereafter, each of the processes in the case where a cold rolling process is included will be described. In the following description, the term "temperature" refers to the surface temperature of, for example, a steel sheet. In addition, an average heating rate and an average cooling rate are calculated on the basis of a surface temperature. An average heating rate is expressed as ((heating end-point temperature−heating start temperature)/heating time). The temperature of a steel sheet after the pickling process, that is, the heating start temperature is equal to a room temperature. An average cooling rate is expressed as ((cooling start temperature−cooling stop temperature)/cooling time).

Hot Rolling Process

The hot rolling process is a process in which a steel material having a chemical composition is subjected to finish rolling at a temperature equal to or higher than the $Ar_3$ transformation temperature and in which the rolled steel sheet is coiled at a temperature of 600° C. or lower. It is possible to manufacture the above-mentioned steel material by preparing molten steel having the chemical composition described above through the use of a refining method in which, for example, a converter is used and by casting the molten steel through the use of a casting method such as a continuous casting method.

Finishing Delivery Temperature: Equal to or Higher Than the $Ar_3$ Transformation Temperature In the case where the finishing delivery temperature is lower than the $Ar_3$ transformation temperature, a microstructure which is inhomogeneous in the thickness direction is formed due to, for example, an increase in the grain diameter of a ferrite phase in the surface layer of a steel sheet. In the case where such inhomogeneity occurs, it is not possible to control the area ratio of a ferrite phase in the surface layer to be 20% or less in the microstructure after the continuous annealing process. Therefore, the finishing delivery temperature is set to be equal to or higher than the $Ar_3$ transformation temperature. Although there is no particular limitation on the upper limit of the finishing delivery temperature, since rolling at an excessively high temperature causes, for example, a scale flaw, it is preferable that the finishing delivery temperature be 1000° C. or lower. Here, as the $Ar_3$ transformation temperature, the value calculated by equation (1) below is used.

$$Ar_3=910-310\times[C]-80\times[Mn]+0.35\times(t-8) \quad (1)$$

Here, [M] denotes the content (mass %) of the chemical element M, and t denotes thickness (mm). In addition, correction terms may be added in accordance with some constituent chemical elements, and, for example, in the case where Cu, Cr, Ni, and Mo are contained, correction terms such as −20×[Cu], −15×[Cr], −55×[Ni], and −80×[Mo] may be respectively added to the right-hand side of equation (1).

Coiling Temperature: 600° C. or Lower

In the case where the coiling temperature is higher than 600° C., since the metallographic structure of the steel sheet after the hot rolling process includes ferrite and pearlite, the microstructure of the steel sheet after the continuous annealing process or after the continuous annealing process following the cold rolling process includes, in terms of area ratio, more than 5% of cementite. In the case where the area ratio of cementite is more than 5%, there is a deterioration in bending workability. Therefore, the coiling temperature is set to be 600° C. or lower. Here, it is preferable that the coiling temperature be 200° C. or higher in order to prevent a deterioration in the shape of a hot-rolled steel sheet.

Pickling Process

The pickling process is a process in which the hot-rolled steel sheet, which has been obtained in the hot rolling process, is subjected to pickling. The pickling process is performed in order to remove black scale which has been generated on the surface of a steel sheet. Here, there is no particular limitation on pickling conditions.

Cold Rolling Process

The cold rolling process is a process in which the pickled hot-rolled steel sheet is subjected to cold rolling. In accordance with aspects of the present invention, it is preferable that cold rolling process be performed after the pickling process and before the continuous annealing process. In the case where the rolling reduction of cold rolling is less than 40%, since the recrystallization of a ferrite phase is less likely to progress, a non-recrystallized ferrite phase is retained in a microstructure after the continuous annealing process, which may result in a decrease in bending workability. Therefore, it is preferable that the rolling reduction of cold rolling be 40% or more. In addition, in the case where the rolling reduction of cold rolling is excessively high, since there is an increase in load placed on rolling rolls, rolling troubles such as chattering and fracturing of a steel sheet may occur. Therefore, it is preferable that the rolling reduction of cold rolling be 70% or less.

Continuous Annealing Process

In the continuous annealing process, a cold-rolled steel sheet is heated to a temperature range of 570° C. or higher at an average heating rate of 2° C./s or more, a holding time during which the cold-rolled steel sheet is held in a temperature range equal to or higher than the $Ac_3$ transformation temperature is 60 seconds or more, the held cold-rolled steel sheet is cooled to a temperature range of 620° C. to 740° C. at an average cooling rate of 0.1° C./s to 8° C./s, a holding time during which the cooled cold-rolled steel sheet is held in the temperature range is 10 seconds to 50 seconds, the held cold-rolled steel sheet is cooled to a temperature range of 400° C. or lower at an average cooling rate of 5° C./s to 50° C./s, and a holding time during which the cooled cold-rolled steel sheet is held in the temperature range of 150° C. or higher and 400° C. or lower in this cooling operation is 200 seconds to 800 seconds.

Heating to Temperature Range of 570° C. or Higher at Average Heating Rate of 2° C./s or More In the case where the heating end-point temperature is lower than 570° C., since a heating rate in a temperature range in which the recrystallization of ferrite occurs is low, there is coarsening of the microstructure in the surface layer of a steel sheet after the continuous annealing process due to the progress of recrystallization, which may result in a deterioration in bending workability. In the case where the average heating rate is less than 2° C./s, since a furnace which is longer than usual is needed, there is an increase in energy consumption, which results in an increase in cost and a decrease in productivity. Here, it is preferable that the upper limit of the average heating rate be 10° C./s or less from the viewpoint of the control of the area ratio of a ferrite phase in a surface layer.

Holding in Temperature Range Equal to or Higher Than $Ac_3$ Transformation Temperature for 60 Seconds or More In order to practice this holding operation, which is performed after "heating to temperature range of 570° C. or higher" has been performed, in the case where the heating end-point temperature of "heating to temperature range of 570° C. or higher" is lower than the $Ac_3$ transformation temperature, it is necessary that heating be additionally continued to a temperature equal to or higher than $Ac_3$ transformation temperature thereafter. Even in the case where the heating end-point temperature of "heating to temperature range of 570° C. or higher" is equal to or higher than $Ac_3$ transformation temperature, heating may additionally be continued to a desired temperature so that the above-described holding operation may be performed. There is no particular limitation on the conditions used for such additional heating. What is important is the time (holding time) during which a cold-rolled steel sheet is retained in a temperature range equal to or higher than the $Ac_3$ transformation temperature, and the holding time is not limited to the time during which the steel sheet is held at a constant temperature.

In the case where the annealing temperature (holding temperature) is lower than the $Ac_3$ transformation temperature or in the case where the annealing time (holding time) is less than 60 seconds, since cementite which has been formed in the hot rolling process is not sufficiently dissolved in the annealing process, an insufficient amount of austenite phase is formed so that an insufficient amount of a bainite phase and/or a martensite phase is formed when cooling is performed in the annealing process, which results in insufficient strength. In addition, in the case where the annealing temperature is lower than the $Ac_3$ transformation temperature or in the case where the annealing time is less than 60 seconds, since the area ratio of cementite becomes more than 5%, there is a decrease in bending workability. In addition, there is no particular limitation on the upper limit of the annealing temperature, in the case where the annealing temperature is higher than 900° C., there is an increase in cost due to an excessive energy consumption. Therefore, it is preferable that the upper limit of the annealing temperature be 900° C. Although there is no particular limitation on the upper limit of the annealing time, in the case where the holding time is more than 200 seconds, the effects become saturated, and there is an increase in cost. Therefore, it is preferable that the annealing time be 200 seconds or less. Here, as the $Ac_3$ transformation temperature, the value calculated by equation (2) below is used.

$$Ac_3=910-203\times([C])^{1/2}-15.2\times[Ni]+44.7\times[Si]+104\times[V]+31.5\times[Mo]-30\times[Mn]-11\times[Cr]-20\times[Cu]+700\times[P]+400\times[Al]+400\times[Ti] \quad (2)$$

Here, [M] denotes the content (mass %) of the chemical element M.

Cooling to Temperature Range of 620° C. to 740° C. at Average Cooling Rate of 0.1° C./s to 8° C./s This cooling operation is a cooling operation in which cooling is performed from the above-described holding temperature (temperature in a temperature range equal to or higher than the $Ac_3$ transformation temperature) to a temperature range of 620° C. to 740° C. at average cooling rate of 0.1° C./s to 8° C./s.

In the case where the average cooling rate is less than 0.1° C./s, since an excessive amount of ferrite is precipitated in the surface layer of a steel sheet during cooling, the area ratio of a ferrite phase in the surface layer becomes more than 20%, which results in a deterioration in bending workability. On the other hand, in the case where the average cooling rate is more than 8° C./s, since the area ratio of a ferrite phase in the surface layer becomes less than 5%, there is a deterioration in bending workability. It is preferable that the average cooling rate be 0.5° C./s to 5° C./s. In the case where the cooling stop temperature is lower than 620° C., since an excessive amount of ferrite is precipitated in the surface layer of a steel sheet during cooling, the area ratio of a ferrite phase in the surface layer becomes more than 20%, and there is a deterioration in bending workability. On the other hand, in the case where the cooling stop temperature is higher than 740° C., since the area ratio of a ferrite phase in the surface layer becomes less than 5%, there is a deterioration in bending workability. It is preferable that the cooling stop temperature be within a temperature range of 640° C. to 720° C.

Holding in Temperature Range of Cooling Stop Temperature for 10 Seconds to 50 Seconds The holding in the above-described temperature range of the cooling stop temperature is one of the important requirements in the manufacturing method according to aspects of the present invention. In the case where the holding time is less than 10 seconds, since ferrite transformation in the surface layer of a steel sheet does not progress homogeneously across the width of the steel sheet, it is not possible to form a microstructure in which the area ratio of a ferrite phase in the surface layer of the steel sheet is 5% or more after continuous annealing has been performed, which results in a decrease in bending workability. In the case where the holding time is more than 50 seconds, since there is an excessive increase in the area ratio of a ferrite phase in the surface layer, there is an increase in the difference in hardness between a ferrite phase and a bainite phase or a martensite phase, which results in a decrease in bending workability. It is preferable that the holding time be 15 seconds to 40 seconds. Here, the term "a holding time" refers to a time (holding time) during which a cold-rolled steel sheet is retained in the temperature range of the cooling stop temperature, and the holding time is not limited to a time during which a cold-rolled steel sheet is held at a constant temperature.

Cooling to Temperature Range of 400° C. or Lower at Average Cooling Rate of 5° C./s to 50° C./s This cooling operation is a cooling operation in which cooling is performed to a cooling stop temperature in the temperature range of 400° C. or lower at an average cooling rate of 5° C./s to 50° C./s after "holding in the temperature range of the cooling stop temperature for 10 seconds to 50 seconds" has been performed.

This condition regarding the average cooling rate is one of the important requirements in accordance with aspects of the present invention. By performing rapid cooling to a temperature of 400° C. at the highest at the specified average cooling rate, it is possible to control the area ratio of a ferrite phase and a bainite phase and/or a martensite phase. In the case where the average cooling rate is less than 5° C./s, since an excessive amount of ferrite phase is precipitated during cooling, the area ratio of a bainite phase and/or a martensite phase becomes less than 75%, which results in a decrease in strength. In the case where the average cooling rate is more than 50° C./s, since the area ratio of a ferrite phase in the surface layer becomes less than 5%, there is a deterioration in bending workability. Also, in the case where the average cooling rate is more than 50° C./s, there is a deterioration in the shape of a steel sheet. Therefore, the average cooling rate of this cooling operation is set to be 50° C./s or less. It is preferable that cooling be performed to a cooling stop temperature in the temperature range of 330° C. or lower at an average cooling rate of 10° C./s to 40° C./s.

Holding in Temperature Range of 150° C. or Higher and 400° C. or Lower for 200 Seconds to 800 Seconds This holding operation is performed under the condition of a holding time of 200 seconds to 800 seconds after "cooling to a temperature range of 400° C. or lower at an average cooling rate of 5° C./s to 50° C./s". In addition, the above-described holding operation may be performed after cooling has been additionally performed following "cooling to a temperature range of 400° C. or lower at an average cooling rate of 5° C./s to 50° C./s".

In the case where the holding time is less than 200 seconds, since bainite transformation does not progress in the case where a bainite phase exists in a second phase, the area ratio of a bainite phase and/or a martensite phase in a steel sheet after continuous annealing has been performed does not become 75% or more, which makes it difficult to achieve satisfactory strength. In the case where the holding temperature is higher than 400° C., since the area ratio of cementite becomes more than 5%, there is a decrease in bending workability. In the case where the holding time is more than 800 seconds, since the tempering of a martensite phase excessively progresses, there is a decrease in strength. It is preferable that holding be performed in a temperature range of 150° C. or higher and 330° C. or lower for 300 seconds to 650 seconds. Here, the term "a holding time" refers to a time (holding time) during which a cold-rolled steel sheet is retained in the temperature range described above, and the holding time is not limited to a time during which a cold-rolled steel sheet is held at a constant temperature. Here, there is no particular limitation on a holding time in a temperature range of lower than 150° C., since the holding time has almost no influence on mechanical properties.

Based on the above description, it is possible to obtain the high-strength steel sheet having a tensile strength of 1180 MPa or more and excellent bending workability according to aspects of the present invention.

Here, in the heating treatments and the cooling treatments in the manufacturing method according to aspects of the present invention, it is not necessary that the holding temperatures be constant as long as the temperatures are within the ranges described above, and there is no problem even in the case where the cooling rates or the heating rates vary during cooling or heating as long as the cooling rates and heating rates are within the specified ranges. In addition, with any kind of equipment being used for the heat treatments, the gist of the present invention is not undermined as long as the requirements regarding the thermal histories are satisfied. In addition, performing skin pass rolling for the purpose of shape correction is within the scope of the present invention. It is preferable that skin pass rolling be performed with an elongation rate of 0.3% or less. In accordance with aspects of the present invention, although it is assumed that a steel material is manufactured through commonly used steel-making process, casting process, and hot rolling process, a case where a steel material is manufactured through a process in which, for example, all or part of a hot rolling process is omitted by using, for example, a thin-slab casting method is also within the scope of the present invention.

Moreover, in accordance with aspects of the present invention, even in the case where the obtained high-strength steel sheet is subjected to various surface treatments such as a chemical conversion treatment, there is no decrease in the effects of the present invention.

EXAMPLES

Hereafter, aspects of the present invention will be specifically described on the basis of examples.

Steel materials (slabs) having the chemical compositions given in Table 1 were used as starting materials. These steel materials were subjected to heating to the heating temperatures given in Table 2 (Table 2-1 and Table 2-2 are combined to form Table 2) and Table 3 (Table 3-1 and Table 3-2 are combined to form Table 3), then subjected to hot rolling under the conditions given in Table 2 and Table 3, subjected to pickling, subjected to cold rolling, and then subjected to continuous annealing. Some of the steel sheets (steel sheet No. 5) was not subjected to cold rolling.

Microstructure observation and the evaluation of tensile properties and bending workability were performed on the cold-rolled steel sheets (No. 5 was a steel sheet) obtained as described above. The determination methods will be described below.

(1) Microstructure Observation

It is possible to determine the area ratio of each of the microstructures, that is, a ferrite phase, a bainite phase, a martensite phase, and cementite by polishing the cross section in the thickness direction parallel to the rolling direction of a steel sheet, by then etching the polished cross section by using a 3%-nital solution, by then observing 10 fields of view at a position located at ¼ of the thickness by using a scanning electron microscope (SEM) at a magnification of 2000 times, and by then analyzing the observed images by image analysis processing using image analysis software "Image-Pro Plus ver. 4.0" manufactured by Media Cybernetics, Inc. The area ratios of a ferrite phase and cementite were respectively defined as the area ratios, which had been determined by identifying these metallographic structures by performing a visual test on microstructure photographs taken by using a SEM and by performing image analysis on the photographs, divided by the areas of the analyzed fields of view. Since the remaining metallographic structures according to aspects of the present invention which are different from a ferrite phase, a retained austenite phase, and cementite are a bainite phase and/or a martensite phase, the area ratio of a bainite phase and/or a martensite phase is defined as the area ratio of the metallographic structures which are different from a ferrite phase, a retained austenite phase, and cementite. The meaning of the term "bainite" in accordance with aspects of the present invention includes both so-called upper bainite, in which plate-type cementite is precipitated along the interface of lath-structured ferrite, and so-called lower bainite, in which cementite is finely dispersed inside lath-structured ferrite. The area ratio of a retained austenite phase was determined by grinding the surface of a steel sheet in the thickness direction, by further performing chemical polishing on the ground surface in order to remove 0.1 mm in the thickness direction so that the position located at ¼ of the thickness from the surface was exposed, by then determining the integrated intensities of the (200) plane, (220) plane, and (311) plane of fcc iron and the (200) plane, (211) plane, and (220) plane of bcc iron by using the Kα ray of Mo with an X-ray diffractometer, and by then deriving the amount of retained austenite from the determined values. The area ratio of each of the metallographic structures, that is, a ferrite phase, a bainite phase, a martensite phase, and cementite was defined as the average value of the area ratios of each of the metallographic structures which had been respectively determined in the 10 fields of view.

Area Ratio of Ferrite Phase in Surface Layer

The above-described microstructure was, after preparation of polishing the cross section in the thickness direction parallel to the rolling direction of a steel sheet and then etching the polished cross section by using a 3%-nital solution, observed in 10 fields of view in a region within 50 μm from the surface in the thickness direction of the steel sheet by using a scanning electron microscope (SEM) at a magnification of 2000 times, and the area ratio of a ferrite phase was determined by analyzing the observed images by image analysis processing using image analysis software "Image-Pro Plus ver. 4.0" manufactured by Media Cybernetics, Inc. That is, the area ratio of a ferrite phase in each of the observation fields of view was determined by distinguishing a ferrite phase on the digital image through image analysis and by performing image processing. The area ratio of a ferrite phase in a region within 50 μm from the surface in the thickness direction was derived by calculating the average value of the area ratios of these 10 fields of view.

(2) Tensile Properties

A tensile test (JIS Z 2241 (2011)) was performed on a JIS No. 5 tensile test piece which had been taken from the obtained steel sheets in a direction at a right angle to the rolling direction of the steel sheet. By performing the tensile test until breaking occurred, tensile strength and breaking elongation (ductility) were determined. In accordance with aspects of the present invention, strength is 1180 MPa or more. Further, in accordance with aspects of the present invention, in addition to excellent bending workability, it is possible to achieve excellent tensile strength-ductility balance represented by a product of tensile strength (TS) and ductility (El) of 11500 MPa·% or more, and such a case is judged as a case of good ductility. The product is preferably 12000 MPa·% or more.

(3) Bending Workability

Bending workability was evaluated on the basis of a V-block method prescribed in JIS Z 2248. Here, a bending test was performed so that the direction of a bending ridge line was along the rolling direction. Evaluation samples were taken at five positions in the width direction of the steel sheet, that is, at ⅛ of the width (w), ¼ of w, ½ of w, ¾ of w, and ⅞ of w. In the bending test, whether or not a crack occurred on the outer side of the bending position was checked by performing a visual test, the minimum bending radius with which a crack did not occur was defined as a limit bending radius. In accordance with aspects of the present invention, the average value of the limit bending radii of the five positions was defined as the limit bending radius of a steel sheet. In Table 2 and Table 3, the ratio of the limit bending radius to the thickness (R/t) is given. In accordance with aspects of the present invention, a case where R/t was 3.0 or less was judged as good. Here, in the case where bending workability widely varies in the width direction of a steel sheet, since the limit bending radius is large at a specified position in the width direction, and since the ratio of the limit bending radius to the thickness (R/t) is also large at this position, it is possible to evaluate a variation in bending workability in the width direction of a steel sheet on the basis of the ratio of the limit bending radius to the thickness (R/t).

The results obtained as described above are given along with the conditions in Table 2 and Table 3.

TABLE 1

| Steel Code | C | Si | Mn | P | S | Al | N | Cr | V | Sb | Mo |
|---|---|---|---|---|---|---|---|---|---|---|---|
| A | 0.124 | 0.66 | 2.55 | 0.008 | 0.0010 | 0.037 | 0.0034 | 0 | 0 | 0.011 | 0 |
| B | 0.105 | 0.53 | 2.79 | 0.010 | 0.0008 | 0.035 | 0.0040 | 0 | 0 | 0.010 | 0 |
| C | 0.131 | 0.56 | 2.57 | 0.009 | 0.0011 | 0.042 | 0.0036 | 0.05 | 0 | 0.009 | 0 |
| D | 0.148 | 0.51 | 2.43 | 0.010 | 0.0009 | 0.050 | 0.0039 | 0 | 0 | 0.012 | 0 |
| E | 0.130 | 0.32 | 2.54 | 0.009 | 0.0012 | 0.042 | 0.0030 | 0 | 0 | 0.010 | 0 |
| F | 0.134 | 0.55 | 2.51 | 0.010 | 0.0011 | 0.048 | 0.0035 | 0.25 | 0 | 0.009 | 0 |
| G | 0.126 | 0.47 | 2.66 | 0.013 | 0.0016 | 0.031 | 0.0047 | 0 | 0.08 | 0.014 | 0 |
| H | 0.113 | 0.54 | 2.58 | 0.009 | 0.0014 | 0.043 | 0.0033 | 0 | 0 | 0.008 | 0.18 |
| I | 0.127 | 0.58 | 2.70 | 0.017 | 0.0013 | 0.054 | 0.0028 | 0.06 | 0.09 | 0.007 | 0 |
| J | 0.132 | 0.56 | 2.57 | 0.010 | 0.0009 | 0.046 | 0.0031 | 0.05 | 0 | 0.009 | 0.09 |
| K | 0.119 | 0.49 | 2.48 | 0.021 | 0.0015 | 0.039 | 0.0042 | 0 | 0 | 0.015 | 0 |
| L | 0.125 | 0.53 | 2.52 | 0.014 | 0.0018 | 0.056 | 0.0035 | 0 | 0 | 0.013 | 0 |
| M | 0.131 | 0.57 | 2.55 | 0.011 | 0.0012 | 0.044 | 0.0043 | 0.08 | 0 | 0.006 | 0.06 |
| N | 0.128 | 0.59 | 2.59 | 0.009 | 0.0009 | 0.038 | 0.0037 | 0 | 0 | 0.010 | 0 |
| a | 0.136 | 0.52 | 2.51 | 0.010 | 0.0036 | 0.046 | 0.0040 | 0 | 0 | 0.011 | 0 |
| b | 0.177 | 0.63 | 2.62 | 0.015 | 0.0009 | 0.035 | 0.0029 | 0 | 0 | 0.008 | 0 |
| c | 0.118 | 0.58 | 2.60 | 0.013 | 0.0012 | 0.044 | 0.0038 | 0 | 0.04 | 0.001 | 0 |
| d | 0.052 | 0.65 | 2.59 | 0.009 | 0.0015 | 0.040 | 0.0033 | 0 | 0 | 0.009 | 0 |
| e | 0.129 | 0.51 | 2.56 | 0.036 | 0.0010 | 0.035 | 0.0042 | 0 | 0 | 0.002 | 0 |
| f | 0.134 | 0.56 | 2.53 | 0.012 | 0.0017 | 0.038 | 0.0041 | 0.03 | 0 | 0.001 | 0 |
| g | 0.138 | 0.60 | 2.64 | 0.016 | 0.0016 | 0.047 | 0.0036 | 0 | 0 | 0.004 | 0.03 |
| h | 0.126 | 0.49 | 2.55 | 0.017 | 0.0011 | 0.042 | 0.0037 | 0 | 0 | 0.002 | 0 |
| i | 0.132 | 0.06 | 2.62 | 0.009 | 0.0014 | 0.033 | 0.0044 | 0 | 0 | 0.005 | 0 |
| j | 0.127 | 0.54 | 2.48 | 0.019 | 0.0008 | 0.039 | 0.0032 | 0 | 0 | 0.006 | 0 |

| Steel Code | Cu | Ni | Ti | Nb | B | Ca | REM | $Ar_3$ | $Ac_3$ | Note |
|---|---|---|---|---|---|---|---|---|---|---|
| A | 0 | 0 | 0.015 | 0.038 | 0.0016 | 0.0002 | 0 | 664 | 818 | Example |
| B | 0 | 0 | 0.014 | 0.042 | 0.0015 | 0.0001 | 0 | 651 | 812 | Example |
| C | 0 | 0 | 0.017 | 0.034 | 0.0017 | 0.0001 | 0 | 660 | 815 | Example |
| D | 0 | 0 | 0.016 | 0.035 | 0.0013 | 0.0001 | 0 | 666 | 816 | Example |
| E | 0 | 0 | 0.013 | 0.037 | 0.0014 | 0.0003 | 0 | 663 | 804 | Example |
| F | 0 | 0 | 0.017 | 0.033 | 0.0019 | 0.0003 | 0 | 660 | 816 | Example |
| G | 0 | 0 | 0.011 | 0.043 | 0.0026 | 0.0008 | 0 | 654 | 806 | Example |
| H | 0 | 0 | 0.022 | 0.041 | 0.0018 | 0.0013 | 0 | 651 | 826 | Example |
| I | 0 | 0 | 0.011 | 0.047 | 0.0010 | 0.0010 | 0 | 650 | 821 | Example |
| J | 0 | 0 | 0.027 | 0.019 | 0.0012 | 0.0002 | 0 | 660 | 821 | Example |
| K | 0.08 | 0.07 | 0.018 | 0.036 | 0.0006 | 0.0009 | 0 | 666 | 824 | Example |
| L | 0 | 0 | 0.015 | 0.034 | 0.0011 | 0.0001 | 0 | 666 | 826 | Example |
| M | 0 | 0 | 0.014 | 0.039 | 0.0015 | 0.0013 | 0.0021 | 662 | 817 | Example |
| N | 0 | 0 | 0.015 | 0.038 | 0.0016 | 0.0001 | 0 | 661 | 814 | Example |
| a | 0 | 0 | 0.022 | 0.040 | 0.0018 | 0.0014 | 0 | 663 | 818 | Comparative Example |
| b | 0 | 0 | 0.020 | 0.028 | 0.0011 | 0.0008 | 0 | 642 | 807 | Comparative Example |
| c | 0 | 0 | 0.015 | 0.031 | 0.0008 | 0.0013 | 0 | 662 | 821 | Comparative Example |
| d | 0 | 0 | 0.022 | 0.029 | 0.0012 | 0.0006 | 0 | 682 | 847 | Comparative Example |
| e | 0 | 0 | 0.020 | 0.024 | 0.0007 | 0.0002 | 0 | 661 | 830 | Comparative Example |
| f | 0 | 0 | 0.013 | 0.037 | 0.0006 | 0.0001 | 0 | 662 | 814 | Comparative Example |
| g | 0 | 0 | 0.017 | 0.033 | 0.0015 | 0.0007 | 0 | 652 | 819 | Comparative Example |
| h | 0 | 0 | 0.018 | 0.036 | 0.0014 | 0.0003 | 0 | 664 | 819 | Comparative Example |
| i | 0 | 0 | 0.016 | 0.035 | 0.0017 | 0.0011 | 0 | 655 | 787 | Comparative Example |
| j | 0 | 0 | 0.019 | 0.032 | 0.0003 | 0.0009 | 0 | 669 | 824 | Comparative Example |

Underlined portion: out of the range according to the present invention

TABLE 2

| | | Hot Rolling Condition | | | Continuous Annealing Condition | | | | |
|---|---|---|---|---|---|---|---|---|---|
| Steel Sheet No. | Steel Code | Heating Temperature (° C.) | Finish Rolling Temperature (° C.) | Coiling Temperature (° C.) | Thickness (mm) | Average Heating Rate to Temperature Range of 570° C. or Higher (° C./s) | Heating Temperature (° C.) | Soaking Temperature (° C.) | Holding Time in Temperature Range Equal to or Higher than Ac3 (s) |
| 1 | A | 1240 | 880 | 560 | 1.4 | 4 | 620 | 860 | 140 |
| 2 | B | 1240 | 880 | 560 | 1.4 | 4 | 630 | 860 | 110 |
| 3 | C | 1240 | 880 | 560 | 1.4 | 4 | 620 | 850 | 120 |
| 4 | D | 1240 | 880 | 560 | 1.4 | 5 | 620 | 850 | 120 |
| 5 | E | 1240 | 880 | 560 | 2.0 | 5 | 610 | 850 | 120 |
| 6 | F | 1240 | 880 | 560 | 1.4 | 5 | 620 | 840 | 100 |
| 7 | G | 1240 | 880 | 560 | 1.4 | 13 | 630 | 850 | 140 |
| 8 | H | 1240 | 880 | 560 | 1.4 | 11 | 600 | 840 | 130 |
| 9 | I | 1240 | 880 | 560 | 1.4 | 2 | 580 | 860 | 80 |
| 10 | J | 1240 | 880 | 560 | 1.4 | 7 | 640 | 850 | 130 |
| 11 | K | 1240 | 880 | 560 | 1.4 | 5 | 600 | 850 | 90 |
| 12 | L | 1240 | 880 | 560 | 1.4 | 6 | 610 | 860 | 150 |
| 13 | M | 1240 | 880 | 560 | 1.4 | 11 | 600 | 850 | 170 |
| 14 | N | 1240 | 880 | 560 | 1.4 | 4 | 630 | 860 | 120 |
| 15 | a | 1240 | 880 | 560 | 1.4 | 8 | 640 | 850 | 130 |
| 16 | b | 1240 | 880 | 560 | 1.4 | 12 | 590 | 860 | 180 |
| 17 | c | 1240 | 880 | 560 | 1.4 | 14 | 620 | 850 | 110 |
| 18 | d | 1240 | 880 | 560 | 1.4 | 9 | 600 | 860 | 60 |
| 19 | e | 1240 | 880 | 560 | 1.4 | 4 | 650 | 850 | 140 |
| 20 | f | 1240 | 880 | 560 | 1.4 | 3 | 610 | 850 | 100 |
| 21 | g | 1240 | 880 | 560 | 1.4 | 2 | 600 | 850 | 120 |
| 22 | h | 1240 | 880 | 560 | 1.4 | 4 | 580 | 850 | 130 |
| 23 | i | 1240 | 880 | 560 | 1.4 | 5 | 630 | 850 | 150 |
| 24 | j | 1240 | 880 | 560 | 1.4 | 5 | 600 | 850 | 140 |

| | | Microstructure | | | | | Property | | |
|---|---|---|---|---|---|---|---|---|---|
| Steel Sheet No. | Steel Code | Area Ratio of Ferrite (%) | Area Ratio of Bainite and/or Martensite (%) | Area Ratio of Cementite (%) | Area Ratio of Ferrite within 50 μm From Surface in Thickness Direction (%) | Other | Yield Strength (MPa) | Tensile Strength (MPa) | YR |
| 1 | A | 12 | 85 | 3 | 15 | — | 976 | 1283 | 0.76 |
| 2 | B | 15 | 81 | 4 | 13 | — | 889 | 1205 | 0.74 |
| 3 | C | 9 | 89 | 2 | 12 | — | 911 | 1247 | 0.73 |
| 4 | D | 6 | 90 | 4 | 11 | — | 1089 | 1342 | 0.81 |
| 5 | E | 13 | 84 | 3 | 14 | — | 889 | 1226 | 0.73 |
| 6 | F | 10 | 88 | 2 | 12 | — | 951 | 1261 | 0.75 |
| 7 | G | 8 | 87 | 5 | 15 | — | 986 | 1244 | 0.79 |
| 8 | H | 12 | 85 | 3 | 11 | — | 903 | 1260 | 0.72 |
| 9 | I | 24 | 75 | 1 | 19 | — | 1054 | 1338 | 0.79 |
| 10 | J | 6 | 88 | 2 | 11 | Retained Austenite | 972 | 1196 | 0.81 |
| 11 | K | 11 | 88 | 1 | 14 | — | 1018 | 1269 | 0.80 |
| 12 | L | 10 | 86 | 4 | 13 | — | 964 | 1253 | 0.77 |
| 13 | M | 13 | 84 | 3 | 18 | — | 1075 | 1315 | 0.82 |
| 14 | N | 8 | 90 | 2 | 12 | — | 1026 | 1264 | 0.81 |
| 15 | a | 9 | 86 | 5 | 19 | — | 1105 | 1307 | 0.85 |
| 16 | b | 1 | 91 | 6 | 3 | Retained Austenite | 1303 | 1439 | 0.91 |
| 17 | c | 7 | 89 | 4 | 31 | — | 831 | 1186 | 0.70 |
| 18 | d | 53 | 35 | 12 | 19 | — | 512 | 914 | 0.56 |
| 19 | e | 16 | 81 | 3 | 28 | — | 968 | 1228 | 0.79 |
| 20 | f | 12 | 84 | 4 | 32 | — | 952 | 1243 | 0.77 |
| 21 | g | 17 | 80 | 3 | 33 | — | 984 | 1342 | 0.73 |
| 22 | h | 22 | 76 | 2 | 27 | — | 882 | 1251 | 0.71 |
| 23 | i | 13 | 82 | 5 | 35 | — | 879 | 1239 | 0.71 |
| 24 | j | 11 | 86 | 3 | 33 | — | 968 | 1276 | 0.76 |

TABLE 2-continued

| | Continuous Annealing Condition | | | | | | |
|---|---|---|---|---|---|---|---|
| | Average Cooling Rate to Temperature Range of 620° C. to 740° C. (° C.) | Cooling Stop Temperature (° C.) | Holding Time in Temperature Range of 620° C. to 740° C. (s) | Average Cooling Rate to Temperature Range of 400° C. or Lower (° C./s) | Cooling Stop Temperature (° C.) | Holding Time in Temperature Range of 150° C. or Higher and Lower than 400° C. (s) | Note |
| 1 | 1.8 | 660 | 18 | 37 | 280 | 430 | Example |
| 2 | 3.4 | 680 | 37 | 18 | 310 | 510 | Example |
| 3 | 1.5 | 680 | 22 | 22 | 260 | 470 | Example |
| 4 | 1.1 | 660 | 35 | 36 | 280 | 530 | Example |
| 5 | 3.6 | 680 | 30 | 19 | 240 | 490 | Example |
| 6 | 4.3 | 700 | 38 | 24 | 310 | 440 | Example |
| 7 | 5.8 | 630 | 21 | 45 | 360 | 560 | Example |
| 8 | 2.6 | 640 | 45 | 29 | 210 | 780 | Example |
| 9 | 6.4 | 710 | 13 | 13 | 250 | 320 | Example |
| 10 | 2.9 | 680 | 24 | 30 | 290 | 480 | Example |
| 11 | 7.2 | 650 | 15 | 18 | 370 | 650 | Example |
| 12 | 5.7 | 670 | 36 | 21 | 220 | 490 | Example |
| 13 | 2.0 | 690 | 18 | 9 | 270 | 530 | Example |
| 14 | 1.2 | 670 | 26 | 24 | 270 | 490 | Example |
| 15 | 6.4 | 690 | 19 | 31 | 300 | 460 | Comparative Example |
| 16 | 5.3 | 630 | 46 | 7 | 360 | 720 | Comparative Example |
| 17 | 1.9 | 610 | 21 | 14 | 290 | 300 | Comparative Example |
| 18 | 7.7 | 730 | 12 | 43 | 210 | 260 | Comparative Example |
| 19 | 2.6 | 670 | 27 | 29 | 330 | 510 | Comparative Example |
| 20 | 1.3 | 660 | 48 | 36 | 280 | 460 | Comparative Example |
| 21 | 0.8 | 640 | 32 | 24 | 240 | 440 | Comparative Example |
| 22 | 1.4 | 650 | 35 | 37 | 220 | 570 | Comparative Example |
| 23 | 3.5 | 710 | 17 | 25 | 250 | 490 | Comparative Example |
| 24 | 4.8 | 680 | 24 | 39 | 310 | 530 | Comparative Example |

| | Property | | | |
|---|---|---|---|---|
| | Ductility (%) | El × TS | R/t | Note |
| 1 | 11.2 | 14370 | 2.2 | Example |
| 2 | 12.2 | 14701 | 1.9 | Example |
| 3 | 9.8 | 12221 | 1.6 | Example |
| 4 | 9.6 | 12883 | 1.4 | Example |
| 5 | 9.8 | 12015 | 1.4 | Example |
| 6 | 10.3 | 12988 | 1.5 | Example |
| 7 | 9.9 | 12316 | 1.5 | Example |
| 8 | 10.4 | 13104 | 2.0 | Example |
| 9 | 10.5 | 14049 | 1.7 | Example |
| 10 | 10.1 | 12080 | 1.4 | Example |
| 11 | 11.6 | 14720 | 1.6 | Example |
| 12 | 9.6 | 12029 | 1.9 | Example |
| 13 | 9.2 | 12098 | 1.6 | Example |
| 14 | 9.5 | 12008 | 2.0 | Example |
| 15 | 9.1 | 11894 | 3.4 | Comparative Example |
| 16 | 5.7 | 8202 | 3.6 | Comparative Example |
| 17 | 9.3 | 11030 | 3.6 | Comparative Example |
| 18 | 12.8 | 11699 | 1.6 | Comparative Example |
| 19 | 9.4 | 11543 | 4.0 | Comparative Example |
| 20 | 9.0 | 11187 | 3.9 | Comparative Example |
| 21 | 8.6 | 11541 | 3.7 | Comparative Example |
| 22 | 9.2 | 11509 | 3.7 | Comparative Example |
| 23 | 9.5 | 11771 | 3.6 | Comparative Example |
| 24 | 9.3 | 11867 | 3.8 | Comparative Example |

Underlined portion: out of the range according to the present invention

TABLE 3

| | | Hot Rolling Condition | | | Continuous Annealing Condition | | | | |
|---|---|---|---|---|---|---|---|---|---|
| Steel Sheet No. | Steel Code | Heating Temperature (° C.) | Finish Rolling Temperature (° C.) | Coiling Temperature (° C.) | Thickness (mm) | Average Heating Rate to Temperature Range of 570° C. Higher (° C./s) | Heating Temperature (° C.) | Soaking Temperature (° C.) | Holding Time in Temperature Range Equal to or Higher than Ac3 (s) |
| 25 | C | 1240 | 640 | 520 | 1.4 | 4 | 650 | 860 | 130 |
| 26 | C | 1220 | 870 | 710 | 1.4 | 17 | 630 | 850 | 90 |
| 27 | C | 1220 | 870 | 530 | 1.4 | 5 | 500 | 870 | 120 |
| 28 | C | 1200 | 880 | 590 | 1.4 | 7 | 620 | 870 | 110 |
| 29 | C | 1210 | 860 | 510 | 1.4 | 4 | 640 | 860 | 100 |
| 30 | C | 1240 | 860 | 550 | 1.4 | 4 | 620 | 710 | 120 |
| 31 | C | 1220 | 850 | 560 | 1.4 | 6 | 610 | 860 | 140 |
| 32 | C | 1250 | 870 | 570 | 1.4 | 4 | 640 | 880 | 110 |
| 33 | C | 1210 | 850 | 550 | 1.4 | 5 | 630 | 870 | 120 |
| 34 | C | 1250 | 880 | 570 | 1.4 | 6 | 610 | 880 | 35 |
| 35 | C | 1200 | 890 | 540 | 1.4 | 4 | 640 | 860 | 100 |
| 36 | C | 1220 | 870 | 530 | 1.4 | 5 | 610 | 840 | 120 |
| 37 | C | 1210 | 850 | 520 | 1.4 | 4 | 650 | 850 | 130 |
| 38 | J | 1240 | 860 | 570 | 1.4 | 7 | 640 | 830 | 150 |
| 39 | J | 1220 | 850 | 560 | 1.4 | 4 | 620 | 860 | 140 |
| 40 | J | 1240 | 860 | 530 | 1.4 | 6 | 610 | 880 | 110 |
| 41 | J | 1230 | 860 | 560 | 1.4 | 4 | 630 | 850 | 130 |
| 42 | J | 1240 | 880 | 540 | 1.4 | 4 | 640 | 830 | 120 |
| 43 | J | 1250 | 850 | 520 | 1.4 | 6 | 610 | 830 | 90 |
| 44 | J | 1210 | 860 | 550 | 1.4 | 5 | 650 | 820 | 130 |
| 45 | J | 1220 | 850 | 580 | 1.4 | 7 | 620 | 850 | 80 |
| 46 | J | 1200 | 850 | 510 | 1.4 | 5 | 610 | 840 | 130 |
| 47 | J | 1210 | 850 | 580 | 1.4 | 4 | 640 | 850 | 110 |
| 48 | N | 1250 | 890 | 540 | 1.4 | 6 | 630 | 860 | 130 |
| 49 | N | 1220 | 860 | 530 | 1.4 | 4 | 620 | 830 | 120 |
| 50 | f | 1240 | 870 | 510 | 1.4 | 5 | 600 | 870 | 100 |
| 51 | f | 1200 | 840 | 520 | 1.4 | 7 | 620 | 850 | 110 |
| 52 | C | 1220 | 870 | 570 | 1.4 | 4 | 620 | 860 | 120 |
| 53 | C | 1220 | 870 | 570 | 1.4 | 4 | 620 | 860 | 120 |

| | | Microstructure | | | | | Property | | |
|---|---|---|---|---|---|---|---|---|---|
| Steel Sheet No. | Steel Code | Area Ratio of Ferrite (%) | Area Ratio of Bainite and/or Martensite (%) | Area Ratio of Cementite (%) | Area Ratio of Ferrite within 50 μm From Surface in Thickness Direction (%) | Other | Yield Strength (MPa) | Tensile Strength (MPa) | YR |
| 25 | C | 12 | 85 | 3 | 27 | — | 854 | 1219 | 0.70 |
| 26 | C | 16 | 76 | 8 | 12 | — | 789 | 1202 | 0.66 |
| 27 | C | 13 | 83 | 4 | 2 | — | 924 | 1236 | 0.75 |
| 28 | C | 11 | 87 | 2 | 10 | — | 1012 | 1267 | 0.80 |
| 29 | C | 9 | 88 | 3 | 11 | — | 921 | 1253 | 0.74 |
| 30 | C | 34 | 50 | 16 | 29 | — | 612 | 932 | 0.66 |
| 31 | C | 10 | 89 | 1 | 10 | — | 995 | 1306 | 0.76 |
| 32 | C | 7 | 91 | 2 | 7 | — | 1026 | 1341 | 0.77 |
| 33 | C | 9 | 88 | 3 | 9 | — | 1011 | 1328 | 0.76 |
| 34 | C | 18 | 69 | 13 | 17 | — | 866 | 1019 | 0.85 |
| 35 | C | 11 | 87 | 2 | 8 | — | 972 | 1295 | 0.75 |
| 36 | C | 19 | 77 | 4 | 3 | — | 1045 | 1242 | 0.84 |
| 37 | C | 17 | 78 | 5 | 3 | — | 987 | 1261 | 0.78 |
| 38 | J | 16 | 80 | 4 | 26 | — | 796 | 1193 | 0.67 |
| 39 | J | 2 | 91 | 7 | 2 | — | 1087 | 1437 | 0.76 |
| 40 | J | 32 | 51 | 17 | 18 | — | 795 | 1290 | 0.62 |
| 41 | J | 14 | 83 | 3 | 10 | — | 889 | 1224 | 0.73 |
| 42 | J | 22 | 75 | 1 | 9 | Retained Austenite | 901 | 1202 | 0.75 |
| 43 | J | 17 | 80 | 3 | 12 | — | 877 | 1198 | 0.73 |
| 44 | J | 11 | 73 | 16 | 16 | — | 899 | 1035 | 0.87 |
| 45 | J | 8 | 90 | 2 | 11 | — | 924 | 1188 | 0.78 |
| 46 | J | 14 | 82 | 4 | 3 | — | 894 | 1203 | 0.74 |
| 47 | J | 22 | 75 | 3 | 35 | — | 835 | 1237 | 0.68 |
| 48 | N | 12 | 86 | 2 | 14 | — | 945 | 1240 | 0.76 |
| 49 | N | 33 | 34 | 33 | 38 | — | 661 | 1051 | 0.63 |
| 50 | f | 18 | 77 | 5 | 3 | — | 1002 | 1274 | 0.79 |

TABLE 3-continued

| | | | | | | | | | |
|---|---|---|---|---|---|---|---|---|---|
| 51 | f | 17 | 79 | 4 | 4 | — | 914 | 1256 | 0.73 |
| 52 | C | 0 | 99 | 1 | 6 | — | 1005 | 1352 | 0.74 |
| 53 | C | 0 | 99 | 1 | 6 | — | 978 | 1284 | 0.76 |

| | Continuous Annealing Condition | | | | | | |
|---|---|---|---|---|---|---|---|
| Steel Sheet No. | Average Cooling Rate to Temperature Range of 620° C. to 740° C. (° C./s) | Cooling Stop Temperature (° C.) | Holding Time in Temperature Range of 620° C. to 740° C. (s) | Average Cooling Rate to Temperature Range of 400° C. or Lower (° C./s) | Cooling Stop Temperature (° C.) | Holding Time in Temperature Range of 150° C. or Higher and 400° C. or Lower (s) | Note |
| 25 | 0.9 | 680 | 38 | 25 | 260 | 410 | Comparative Example |
| 26 | 4.8 | 660 | 19 | 37 | 220 | 280 | Comparative Example |
| 27 | 3.6 | 650 | 21 | 33 | 320 | 540 | Comparative Example |
| 28 | 1.9 | 670 | 28 | 26 | 330 | 490 | Example |
| 29 | 2.5 | 680 | 24 | 29 | 240 | 520 | Example |
| 30 | 4.7 | 700 | 36 | 24 | 310 | 430 | Comparative Example |
| 31 | 2.2 | 670 | 21 | 38 | 250 | 510 | Example |
| 32 | 1.4 | 660 | 26 | 33 | 260 | 490 | Example |
| 33 | 3.0 | 680 | 29 | 24 | 280 | 460 | Example |
| 34 | 2.5 | 650 | 22 | 36 | 340 | 520 | Comparative Example |
| 35 | 1.7 | 660 | 30 | 22 | 270 | 480 | Example |
| 36 | 14.3 | 690 | 41 | 31 | 330 | 390 | Comparative Example |
| 37 | 5.6 | 800 | 32 | 35 | 270 | 450 | Comparative Example |
| 38 | 7.4 | 670 | 130 | 18 | 250 | 310 | Comparative Example |
| 39 | 3.1 | 730 | 19 | 80 | 230 | 420 | Comparative Example |
| 40 | 5.7 | 660 | 33 | 24 | 570 | 470 | Comparative Example |
| 41 | 2.4 | 680 | 19 | 27 | 280 | 520 | Example |
| 42 | 3.1 | 660 | 25 | 25 | 300 | 500 | Example |
| 43 | 1.6 | 670 | 23 | 31 | 250 | 680 | Example |
| 44 | 3.8 | 710 | 29 | 19 | 280 | 160 | Comparative Example |
| 45 | 2.3 | 640 | 26 | 22 | 320 | 500 | Example |
| 46 | 6.9 | 650 | 4 | 24 | 240 | 350 | Comparative Example |
| 47 | 4.2 | 570 | 27 | 16 | 380 | 440 | Comparative Example |
| 48 | 1.5 | 680 | 23 | 29 | 310 | 620 | Example |
| 49 | 2.6 | 720 | 29 | 3 | 290 | 460 | Comparative Example |
| 50 | 22.7 | 630 | 16 | 42 | 210 | 370 | Comparative Example |
| 51 | 1.1 | 790 | 18 | 34 | 300 | 480 | Comparative Example |
| 52 | 4.5 | 700 | 15 | 25 | 300 | 450 | Example |
| 53 | 4.5 | 700 | 15 | 25 | 250 | 450 | Example |

| Steel | Property | | | |
|---|---|---|---|---|
| Sheet No. | Ductility (%) | El × TS | R/t | Note |
| 25 | 9.3 | 11337 | 3.5 | Comparative Example |
| 26 | 9.6 | 11539 | 3.6 | Comparative Example |
| 27 | 8.8 | 10877 | 3.8 | Comparative Example |
| 28 | 11.5 | 14571 | 1.4 | Example |
| 29 | 11.1 | 13908 | 1.5 | Example |
| 30 | 12.7 | 11836 | 3.3 | Comparative Example |
| 31 | 10.2 | 13321 | 1.5 | Example |
| 32 | 9.1 | 12203 | 1.6 | Example |
| 33 | 9.9 | 13147 | 1.5 | Example |
| 34 | 10.9 | 11107 | 3.5 | Comparative Example |
| 35 | 10.4 | 13468 | 1.4 | Example |
| 36 | 8.5 | 10557 | 3.9 | Comparative Example |
| 37 | 8.7 | 10971 | 3.8 | Comparative Example |
| 38 | 9.5 | 11334 | 3.9 | Comparative Example |
| 39 | 7.8 | 11209 | 3.6 | Comparative Example |
| 40 | 8.6 | 11094 | 3.4 | Comparative Example |
| 41 | 10.7 | 13097 | 1.5 | Example |
| 42 | 12.9 | 15506 | 1.4 | Example |
| 43 | 12.3 | 14735 | 1.6 | Example |
| 44 | 10.8 | 11178 | 3.5 | Comparative Example |
| 45 | 12.5 | 14850 | 1.9 | Example |
| 46 | 9.2 | 11068 | 3.9 | Comparative Example |
| 47 | 9.4 | 11628 | 3.8 | Comparative Example |
| 48 | 9.7 | 12028 | 1.4 | Example |

TABLE 3-continued

| | | | | |
|---|---|---|---|---|
| 49 | 11.3 | 11876 | 3.3 | Comparative Example |
| 50 | 8.5 | 10829 | 3.8 | Comparative Example |
| 51 | 8.9 | 11178 | 3.7 | Comparative Example |
| 52 | 8.9 | 12033 | 2.4 | Example |
| 53 | 9.1 | 11684 | 2.2 | Example |

Underlined portion: out of the range according to the present invention

As Table 2 and Table 3 indicate, it is clarified that bending workability was good in the case of the examples of the present invention which had microstructures including, in terms of area ratio, 25% or less of a ferrite phase, 75% or more of a bainite phase and/or a martensite phase, and 5% or less of cementite, in which the area ratio of a ferrite phase is 5% to 20% in a surface layer.

On the other hand, in the case of the comparative examples, one or both of strength and bending workability were poor. In particular, it is clarified that, in the case of the comparative examples where the chemical compositions were not appropriate, strength or bending workability was not improved even though the area ratio of a ferrite phase, the area ratio of a bainite phase and/or a martensite phase, the area ratio of cementite, and the area ratio of a ferrite phase in a surface layer were appropriate.

Since the high-strength steel sheet according to aspects of the present invention is excellent in terms of bending workability, the steel sheet can be used as a steel sheet for the weight reduction and strengthening of an automobile body.

The invention claimed is:

1. A high-strength steel sheet having a chemical composition containing, by mass %, C: 0.100% to 0.150%, Si: 0.30% to 0.70%, Mn: 2.20% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, Ca: 0.0015% or less, and the balance being Fe and inevitable impurities, a microstructure including, in terms of area ratio, 25% or less of a ferrite phase, 75% or more of a bainite phase and/or a martensite phase, and 5% or less of cementite, wherein, in a surface layer that is a region within 50 μm from the surface in the thickness direction, the area ratio of a ferrite phase is 5% to 20%, a tensile strength being 1180 MPa or more, and the chemical composition further contains at least one element selected from at least one group consisting of, by mass %, Group I: one or more elements selected from Cr: 0.30% or less, V: 0.10% or less, Mo: 0.20% or less, Cu: 0.10% or less, and Ni: 0.10% or less, and Group II: REM: 0.0010% to 0.0050%.

2. The high-strength steel sheet according to claim 1, the steel sheet further having a YR of 0.85 or less.

3. A method for manufacturing a high-strength steel sheet according to claim 1, the method comprising:

a hot rolling process in which finish rolling is performed on a steel material having a chemical composition containing, by mass %, C: 0.100% to 0.150%, Si: 0.30% to 0.70%, Mn: 2.20% to 2.80%, P: 0.025% or less, S: 0.0020% or less, Al: 0.020% to 0.060%, N: 0.0050% or less, Nb: 0.010% to 0.060%, Ti: 0.010% to 0.030%, B: 0.0005% to 0.0030%, Sb: 0.005% to 0.015%, and Ca: 0.0015% or less, with the balance being Fe and inevitable impurities, at a temperature equal to or higher than the Ara transformation temperature and in which coiling is performed at a temperature of 600° C. or lower;

a pickling process in which pickling is performed on the hot-rolled steel sheet after the hot rolling process; and a continuous annealing process in which the steel sheet which has been pickled in the pickling process is heated to a temperature range of 570° C. or higher at an average heating rate of 2° C./s or more, in which a holding time during which the steel sheet is held in a temperature range equal to or higher than the Acs transformation temperature is 60 seconds or more, in which the held steel sheet is then cooled to a temperature range of 620° C. to 740° C. at an average cooling rate of 0.1° C./s to 8° C./s, in which a holding time during which the cooled steel sheet is held in the temperature range is 10 seconds to 50 seconds, in which the held steel sheet is then cooled to a temperature range of 400° C. or lower at an average cooling rate of 5° C./s to 50° C./s, and in which a holding time during which the cooled steel sheet is held in a temperature range of 150° C. or higher and 400° C. or lower is 200 seconds to 800 seconds.

4. The method for manufacturing a high-strength steel sheet according to claim 1, the method further comprising a cold rolling process in which cold rolling is performed on the pickled steel sheet after the pickling process and before the continuous annealing process.

5. The high-strength steel sheet according to claim 1, wherein the microstructure includes, in terms of area ratio, 11% or more and 25% or less of the ferrite phase.

* * * * *